US008727094B2

(12) United States Patent
Bruner et al.

(10) Patent No.: US 8,727,094 B2
(45) Date of Patent: May 20, 2014

(54) APPARATUS AND METHOD FOR REJECTING JAMMED COINS

(75) Inventors: Philemon L. Bruner, Katy, TX (US); Kurt D. Regenbrecht, Hallettsville, TX (US); Gary L. Mee, Houston, TX (US)

(73) Assignee: Imonex Services, Inc., Sealy, TX (US)

( * ) Notice: Subject to any disclaimer, the term of this patent is extended or adjusted under 35 U.S.C. 154(b) by 1186 days.

(21) Appl. No.: 12/622,425

(22) Filed: Nov. 19, 2009

(65) Prior Publication Data

US 2010/0066490 A1 Mar. 18, 2010

Related U.S. Application Data

(62) Division of application No. 09/497,284, filed on Feb. 2, 2000, now Pat. No. 7,635,059.

(51) Int. Cl.
*G07C 3/00* (2006.01)
*G07F 9/02* (2006.01)
*G07F 1/04* (2006.01)

(52) U.S. Cl.
CPC . *G07F 1/04* (2013.01); *G07F 1/046* (2013.01)
USPC ..... 194/200; 194/266; 194/344; 194/346

(58) Field of Classification Search
CPC ..... G07F 1/04; G07F 1/041; G07F 1/046
USPC ..... 194/200–202, 217, 244, 250, 251, 194/264–266, 282, 291, 292, 294, 295–297, 194/310–313, 321–327, 333, 342, 343–347, 194/349
See application file for complete search history.

(56) References Cited

U.S. PATENT DOCUMENTS 4,667,093 A * 5/1987 MacDonald ..... 250/223 R
5,236,071 A * 8/1993 Lee ..... 194/200
5,647,469 A * 7/1997 Yamagishi et al. ..... 194/200

* cited by examiner

*Primary Examiner* — Jeffrey Shapiro

(57) ABSTRACT

A coin separator and rejector apparatus that will electronically release and return jammed coins, tokens, slugs and the like is disclosed. A coin separator and rejector body is described having one or more downwardly inclined coin races formed therein. The rejector body has an upstream portion and a downstream portion. The coin races further comprise a first wall and a second wall wherein at least a portion of one of the race walls is pivotally connected with the rejector body. A first sensor is located in the upstream portion of the rejector body and a second sensor located in said downstream portion of said rejector body. An actuator is in mechanical connection with the pivotal portion of the race wall. A processor is in electrical communication with the sensors and with said actuator. A coin in an upstream portion of a coin separator and rejector is detected by the first sensor and sends a signal to the processor. The processor is programmed to wait a predetermined period of time to receive a signal from the second sensor indicating that the coin has progressed in the coin race to the second sensor. If the processor receives no signal from the second sensor after a predetermined time period has passed, the processor sends a signal to the actuator to open the pivotally connected portion of the separator and rejector to allow the jammed coin to be released from the separator and rejector.

3 Claims, 4 Drawing Sheets

APPARATUS AND METHOD FOR REJECTING JAMMED COINS

CROSS REFERENCE TO RELATED APPLICATIONS

The present application is a divisional application of co-pending U.S. patent application Ser. No. 09/497,284, filed on Feb. 2, 2000, which is hereby incorporated by reference in its entirety.

FIELD OF THE INVENTION

The present invention relates to coin separators and rejectors and more particularly to coin operated machines where selection and rejection of coins is required.

BACKGROUND OF THE INVENTION

Coin separators and rejectors are widely employed in coin operated machines such as vending machines, public telephones, video games, car washes, laundromats and the like.

Coin separators and rejectors employ a variety of means to separate coins and to reject unwanted coins, tokens, slugs and the like. For example, U.S. Pat. No. 2,292,628 discloses a rejector wherein a coin inserted into a coin slot engages a series of coin cradles disposed within the apparatus and moves downwards across the face of the rejector via a plurality of coin handling cradles until it reaches a particular coin outlet slot. The disadvantage of this and similar devices is the number of moving parts that can fail due to wear by contamination by dirt and corrosives. This results in numerous service calls, leading to an overall loss of profit due to down time and service call fees.

Reducing the number of moving parts has increased the reliability and efficiency of coin separators and rejectors. U.S. Pat. No. 4,911,280 discloses a coin separator and rejector that separates and rejects coins without moving parts. Rather, coins are separated and rejected via downwardly inclined coin races connected by apertures. Protrusions in the races apply precise lateral forces to the downwardly moving coins to selectively alter the paths of coins as they proceed down the coin race.

Other devices employ electronics in the coin selection process. U.S. Pat. No. 5,460,256 discloses a coin sensing device that employs optical sensors located along a coin path. Depending on the diameter of the coin proceeding along the path, the sensors detect the passage of coins and send signals to a processor. The processor calculates a time interval and generates a signal indicating the acceptability of the coin.

In above-referenced devices, jammed coins are removed from the coin separator and rejector via a button that is mechanically connected to the device. This limits the location that manufacturers of coin operated machines can place coin separators and rejectors since the coin return button must be able to be mechanically linked to the coin separator and rejector. Accordingly, effective devices and systems are desired for coin separators and rejectors that do not require mechanical buttons and linkages to remove jammed coins.

SUMMARY OF THE INVENTION

The present invention is directed to a coin separator and rejector apparatus that will electronically release and return jammed coins, tokens, slugs and the like. The present invention has a coin separator and rejector body having one or more downwardly inclined coin races formed therein. The rejector body has an upstream portion and a downstream portion. In addition, the coin races further comprise a first wall and a second wall wherein at least a portion of one of the race walls is pivotally connected with the rejector body. A first sensor is located in the upstream portion of the rejector body and a second sensor located in the downstream portion of said rejector body. An actuator is in mechanical connection with the pivotal portion of the race wall. A processor is in electrical communication with the sensors and with the actuator. In a preferred embodiment the actuating member comprises a solenoid.

In one embodiment, a coin in an upstream portion of a coin separator and rejector is detected by the first sensor and sends a signal to the processor. The processor is programmed to wait a predetermined period of time to receive a signal from the second sensor indicating that the coin has progressed in the coin race to the second sensor. If the processor receives no signal from the second sensor after a predetermined time period has passed, the processor will send a signal to the actuating member to open the pivotally connected portion of the separator and rejector to allow the jammed coin to be released from the separator and rejector. The coin will then be returned to the user.

One feature of the present invention is the omission of a coin return button to return jammed coins. This provides the advantage of allowing manufacturers to locate the coin separator and rejector in areas previously unobtainable due to the necessity of linking a coin return button to the separator and rejector body. Another feature of the present invention is the ability to design the logic of the apparatus in opening the device to return jammed coins. Another advantage provided by this feature is the ability to design the logic to hold the device in an open position if undesirable coins or objects are inserted into the device more than once within a given time period.

Other features and advantages of the present invention will be readily understood by reference to the following drawings and detailed description of the invention.

DETAILED DESCRIPTION OF THE INVENTION

The present invention is directed to a coin separator and rejector apparatus that will electronically release and return jammed coins, tokens, slugs and the like. The present invention has a coin separator and rejector body (rejector body) having one or more downwardly inclined coin races formed therein. The rejector body has an upstream portion and a downstream portion. In addition, the coin races further comprise a first wall and a second wall wherein at least a portion of one of the race walls is pivotally connected with the rejector body. For example, coin separators and rejectors generally incorporate a coin return button mechanically linked to the device. When the button is depressed, it forces the rejector body to pivot into an open position to allow jammed coins to fall out of the coin race and from the rejector body and into a coin return portion. An example of a coin separator and rejector composed of segments hinged together with a coin path formed between the hinged sections is disclosed in U.S. Pat. No. 4,911,280, which is hereby incorporated by reference in its entirety.

A first sensor is located in the upstream portion of the rejector body and a second sensor located in the downstream portion of the rejector body. An actuator is in mechanical connection with the pivotal portion of the race wall. A processor is in electrical communication with the sensors and with the actuator. In a preferred embodiment the actuator comprises a solenoid.

In general, a coin in an upstream portion of the coin separator and rejector of the present invention is detected by the first sensor, which then sends a signal to the processor. The processor is programmed to wait a predetermined period of time to receive a signal from the second sensor indicating that the coin has progressed in the coin race to the second sensor. If the processor receives no signal from the second sensor after a predetermined time period has passed, the processor will send a signal to the actuator member to open the pivotally connected portion of the separator and rejector to allow the jammed coin to be released from the separator and rejector and to be returned to the user.

Figure 1:
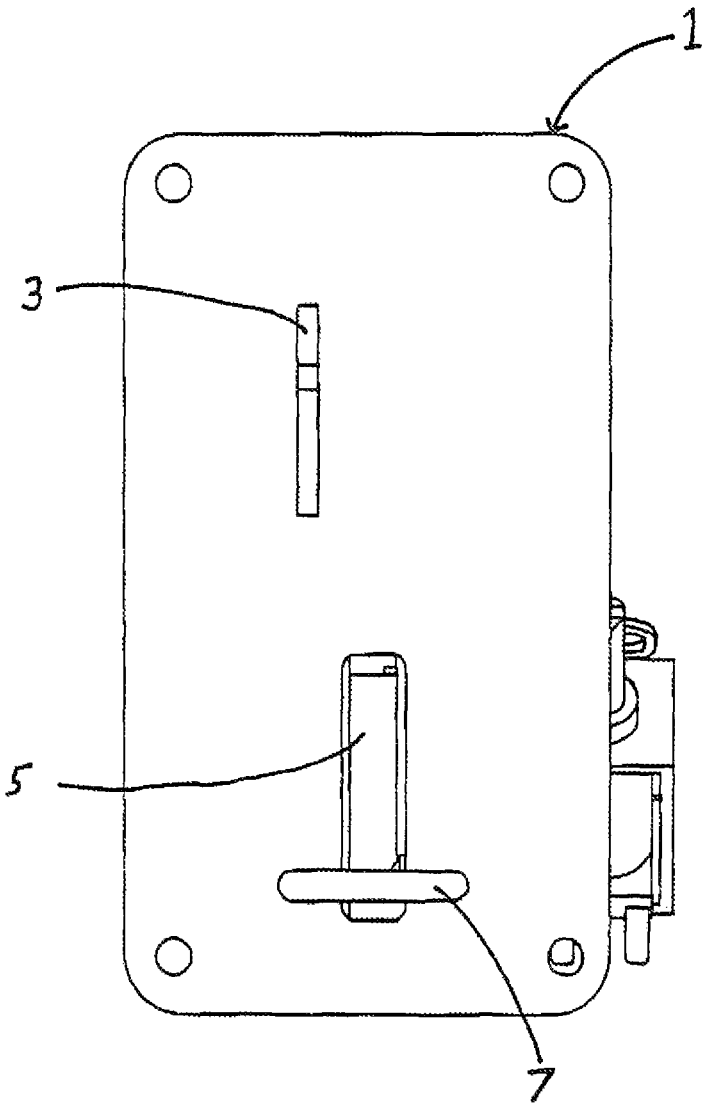
FIG. 1 is a front view illustrating a single coin entry face plate and coin return slot.

Referring to FIG. 1, a face plate 1 is illustrated having a single coin entry slot 3, coin return slot 5 and coin retaining member 7. A coin separator and rejector is mounted to the face plate such that a coin race entry point and the coin return portion of the separator and rejector body is in cooperative alignment with the face plate.

Figure 2:
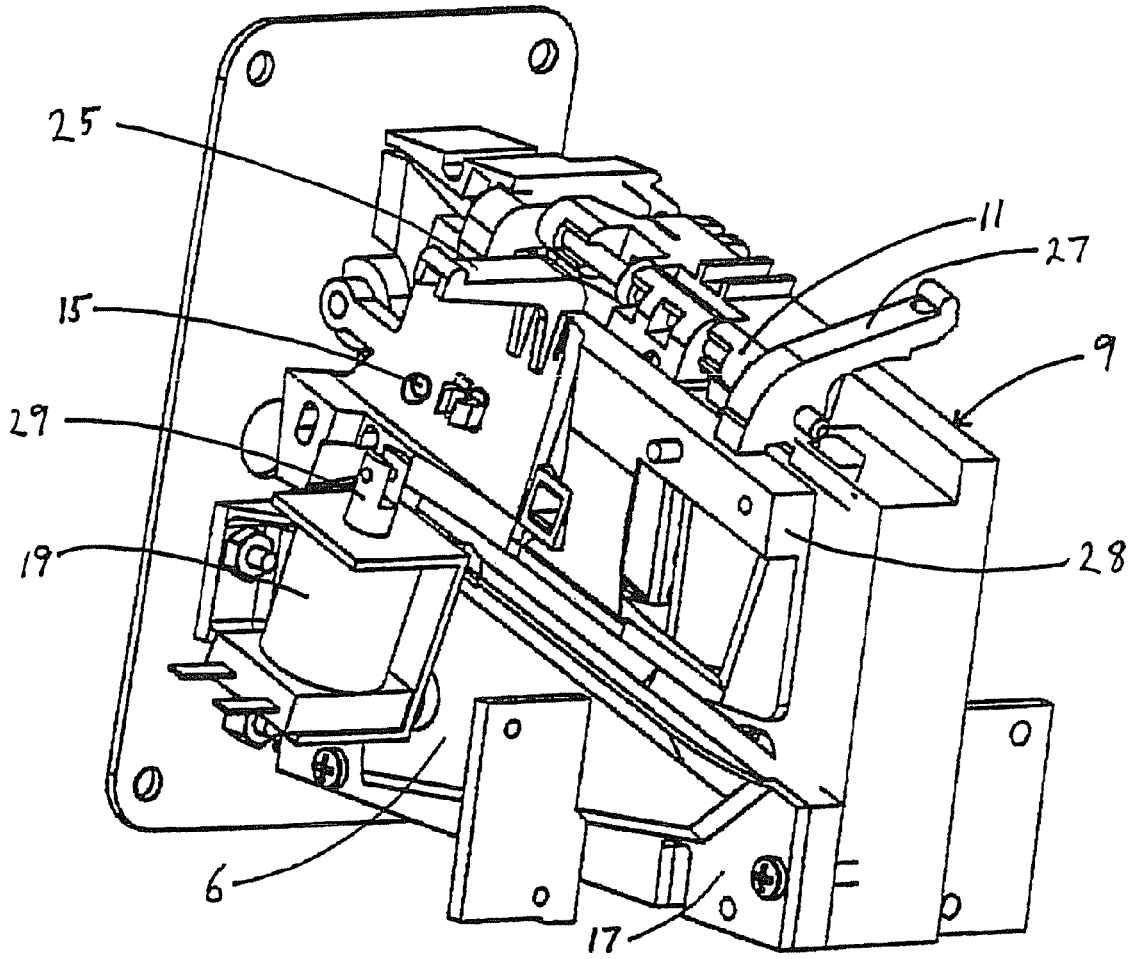
FIG. 2 is a perspective view of one embodiment of the present invention mounted to a faceplate as illustrated in FIG. 1.
Figure 3:
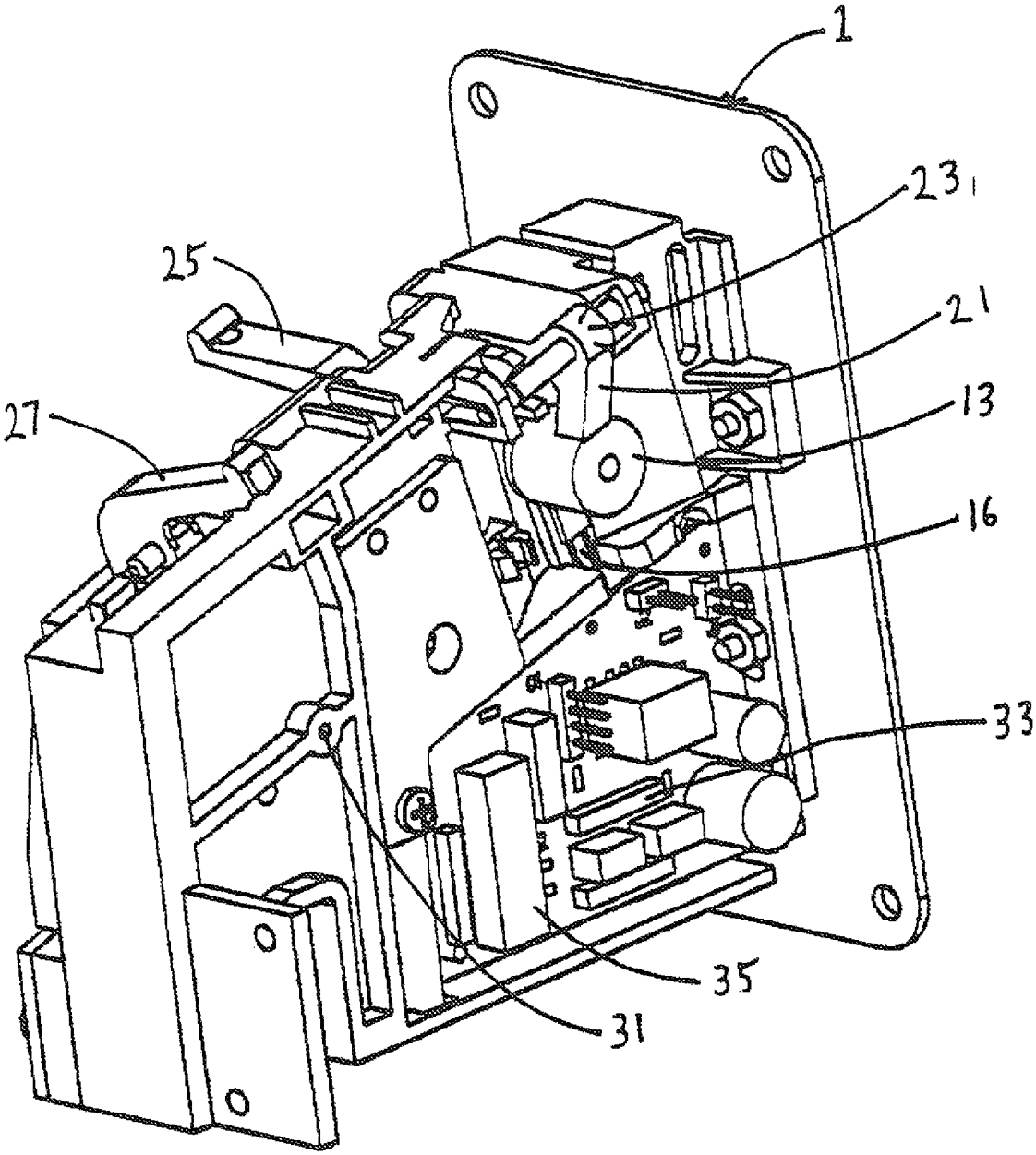
FIG. 3 is a perspective view of the opposite side of the invention illustrated in FIG. 2.

Referring to FIGS. 2 and 3, one embodiment of a rejector body of the present invention is illustrated. A rejector body 9 is mounted to face plate 1. The rejector body 9 is composed of two or more segments hinged together by hinge 11 and having one or more coin races formed in the rejector body therebetween. A magnet 13 is mounted on the rejector body via magnet arm 21 and magnet arm hinge 23. The magnet is mounted adjacent the coin race in the upstream portion of the rejector body near the coin entry slot and serves to attract ferrous coins, slugs, tokens and the like to inhibit or slow further progress of the ferrous object down the coin race. In operation, when the rejector body is pivoted to the open position, the magnet will swing away and release the ferrous object allowing it to fall from the rejector body and into coin return chute 6.

In the practice of the present invention, sensors work in conjunction with the processor to detect the passing of coins through the rejector body. The sensors may be induction coils, Hall effect sensors, light energy sources and light energy detectors working in conjunction (e.g., photoelectric sensors that use diodes to emit and detect light), mechanical switches, or combinations of the above.

Hall effect sensors are used to detect ferrous objects and can be used as an alternative to a magnet that attracts and retains ferrous objects entering the coin race. In this embodiment, a magnetic field is generated by a magnet or electrical current near the Hall effect sensor. A ferrous object passing near the magnetic field will change the magnetic flux and the sensor will detect the presence of the ferrous object in the coin race. The sensor will send a signal to the processor to open the rejector body to release the ferrous object. This embodiment has the advantage of reducing the force required to open the rejector body because the actuator no longer needs to dislodge the coin from the magnet.

In one embodiment of the present invention, an induction coil mounted adjacent the coin race is used in conjunction with the Hall effect to create an electronic signature for each coin transiting the rejector. A test coin is used to establish a signature that is stored in the processor. Coins passing the induction coil create a change in the flux field that is measured and compared to the test coin's signature. If the signature of the coin passing the induction coil matches the signature of the test coin stored in the processor, the coin is accepted and credited. If the coin fails to match the signature of the test coin, the coin is rejected and no credit is issued. In a preferred embodiment, one or more induction coils are used in line with each other. One or more of the coils is driven with a pulsing signal and the other coil or coils measure the magnetic field produced by the pulsed coils.

A number of types and configurations of photoelectric sensors can be employed in the practice of the present invention. In general, the photoelectric sensors operate such that when an object passes between the emitter and detector, the beam is interrupted and opens the circuit. In addition, a photoelectric sensor can be used by placing the emitter and detector side by side. When a reflective object, such as a coin, passes in front of the emitter, the light is reflected back to the detector, and closes the switch. This method works well for determining if something other than a metallic coin, such as a plastic coin, is inserted into the coin race. Photoelectric sensors can also be used with the emitter and detector side by side facing a reflective surface such as a mirror. If an object passes between the diodes and the surface at an oblique angle, the light will be reflected, or blocked away from the detector, thus opening the switch.

In a preferred embodiment, photoelectric sensors are employed. In particular infrared (IR) sensors are positioned in the race walls such that the IR emitters are mounted in the wall on one side of the coin race and corresponding IR detectors or receivers are mounted in the opposite race wall. An example of a suitable emitter and receiver combination for use in the present invention is emitter model SEP8506-002 and receiver model SDP8406-002 manufactured by Micro Switch Honeywell, Freeport, Ill. In this embodiment, the receivers are in electrical connection with a processor. When a coin interrupts the beam passing between the emitter and the receiver, a signal is detected by the processor indicating the progression of a coin to that point in the rejector body.

Referring again to FIGS. 2 and 3, an upstream IR receiver 16 is located adjacent magnet 13 and adjacent the coin race. A corresponding IR emitter 15 is located in the coin race opposite the IR receiver. In a preferred embodiment, the magnet 13 is located in line with the upstream sensor such that if the magnet attracts and retains an object, the sensor will stay tripped and signal the processor to reject the object. A second sensor area 17 is located adjacent one or more coin races positioned in the downstream portion of the rejector body. The second sensor area will contain a sensor for each coin race in the downstream portion of the rejector body. For example, the embodiment illustrated is generally designed for accepting two different coin denominations. As the coins proceed down the coin race, one coin denomination will be retained in a first, or primary, coin race while the other coin denomination will be routed to a second coin race. In a preferred embodiment, the processor is programmed to also issue the proper credit amount based on which downstream sensor is tripped.

Referring again to FIGS. 2 and 3, an actuator 19 is mounted to the rejector body. The actuator responds to an electrical signal from the processor or logic circuit and serves to move a linkage to open the rejector body, allowing a jammed coin or object to fall free of the rejector body. Actuators may be electric motors, solenoids or the like. In a preferred embodiment, the actuator comprises a solenoid. Examples of solenoids useful in the practice of the present invention are Series C-26 (6/12/24/48/115 VDC) or C-8 (12/24/48/115/220 VAC) solenoids manufactured by Lucas and Dormeyer Products, Vandalia, Ohio. The solenoid can operate in a variety of modes in the invention. In one embodiment, no power is applied to the actuator under normal separator and rejector operation and the rejector will be in the closed position. Accordingly, in this embodiment, the actuator is mounted on the rejector body and connected to a hinged segment of the rejector body. Activation of the actuator exerts a force to a linking member causing the hinged segment to pivot outwards, thus opening the rejector body such that a coin or object jammed therein will fall free of the rejector body.

As indicated, the sensors are electrically connected to a processor or logic circuit. In turn the process or logic circuit is electrically connected to the actuator. In a preferred embodiment of the invention, power is applied continuously to the actuator under normal separator and rejector operation, and power is necessary to keep the hinged portion of the rejector body in the closed position. If the power is interrupted to the actuator, the rejector body will move to the open position. In this mode of operation, if electrical power is lost, the rejector will open and all coins inserted into the separator and rejector will be returned. In addition, latching solenoids may be employed wherein an electrical pulse is sent to the solenoid to shift it from one position to the other. Once it is in place, no other power is required. A solenoid wound with a center cap can also be employed wherein the solenoid could be shifted by switching the power to a different winding on the solenoid.

Again referring to FIGS. 2 and 3, in the preferred embodiment, actuator 19 is connected to a first rejector body member 25, such as an arm or a lever, by a linkage (not shown), such as a rod, spring, band or the like connected to member 25 and actuator connection point 29. A corresponding second rejector body member 27, such as an arm or lever, is connected to connection point member 31 by an elastic member such as spring, band or the like (not shown). Rejector body members 25 and 27 are in corresponding mechanical engagement with pivoting rejector body segment 28. As indicated, in this embodiment the force applied by the elastic member to second rejector body member 27 is tensioned to hold the segment in the open position. Accordingly, the actuator is engaged under normal operation and serves to apply an opposing force to the force applied by the elastic member and holds the segment in the closed position. In this configuration, if power is interrupted to the actuator, the segment will pivot outwards under the force applied by the elastic member. In this embodiment a 12-volt solenoid is the preferred actuator. Three volts are applied continuously to the solenoid, which is sufficient to maintain the rejector in the closed position and to keep the solenoid from overheating. Moreover, in this mode, it is desirable to ensure that the solenoid is fully engaged (bottomed out) to avoid overheating.

The controller electronics consist of a microprocessor, power supply and associated electronics required to switch and filter signals being sent from and to the microprocessor. An example of a suitable processor useful in the practice of the present invention is a model AVR 20313 manufactured by Atmel Incorporated, San Jose, Calif. Referring particularly to the embodiment illustrated in FIG. 3, processor 33 (including its associated circuit board) is mounted on the rejector body along with programming DIP switches 35.

The processor runs a program that responds to input from the sensors and other attached equipment. The processor can be programmed to respond to a number of different inputs from the sensor. In one embodiment of the invention, the processor is programmed to measure not only the coin drop time from the upstream sensor to the downstream sensors, but also the transit time of the coin passing the first sensor. This time is used to determine whether the coin is being "flicked" (i.e., forced into the coin race at a high velocity to evade coin selecting and rejecting mechanisms), placed into the coin race attached to a coin retrieval mechanism (e.g., stringing) or slowed or stopped due to detection of a ferrous coin by a magnet. Accordingly, two settings can be used in the processor to determine if the coin passed the upstream sensor too fast (minimum transit time), or too slow (maximum transit time). If the coin transit time fails either test, the rejector body is opened electronically and the coin falls free of the coin race.

Different types of logic can be employed in the present invention. For example, if an undesirable object or coin is inserted into the rejector and rejected once by opening the rejector body, and then inserted again within a predetermined time period, the rejector will be opened and return the coin again. If the rejector opening mechanism is actuated a predetermined number of times within a selected time period, the rejector can be programmed to hold the rejector in the open position for a selected time period before returning to normal operation. The timing intervals can be predetermined to maximize rejection or to maximize acceptance. For example, a particular coin, such as a quarter, may require on average 80 milliseconds to traverse both sensors. Accordingly, a programmer may maximize rejection by setting the time interval to, for example, 75 to 90 milliseconds. If the programmer desires to maximize acceptance, the programmer may select a longer time period, for example, from 10 milliseconds to 200 milliseconds. As noted, the rejector may incorporate a magnet to produce an eddy current with a neodymium or other strong magnet to alter the speed of undesirable coins or objects so that such coins will trigger the actuator to move the rejector body to the open position.

In addition to the rejector functions, the controller can be programmed to perform a variety of additional functions. For example, the controller can include a cycle counter that will count the number of coins that have passed through the acceptor, as well as the number that have been rejected to provide an indication that the separator and rejector is beginning to wear out, thereby allowing the unit to be replaced prior to it actually failing. This signal can be in the form of, for example, a light indicator, such as an LED, or by an electronic interface to another computer. Moreover, the controller can be set to shut off the device if the rejection rate goes beyond a predetermined number, thus providing a notification that the device is not accepting coins properly.

In addition to the above-described functions, the controller can be programmed to display the amount of money that has been accepted, the vend price and the status of the machine (e.g., that it has been shut down for repair). The processor can be programmed to send pulsed signals to the coin operated device to indicate how much money has been accepted, e.g., four pulses when a dollar coin is inserted. The controller can also include a cycle timer and additional switching devices to allow a machine, such as an amusement ride, to run for a predetermined length of time.

In another embodiment of the invention, when the actuator functions such that the rejector body is in the open position, anti-cheat or coin entry block features are triggered such that coins cannot be inserted into the rejector body. Anti-cheat or coin entry portal blocks are disclosed in U.S. patent application Ser. No. 09/239,431 filed Jan. 28, 1999, which is hereby incorporated by reference in its entirety.

Figure 4:
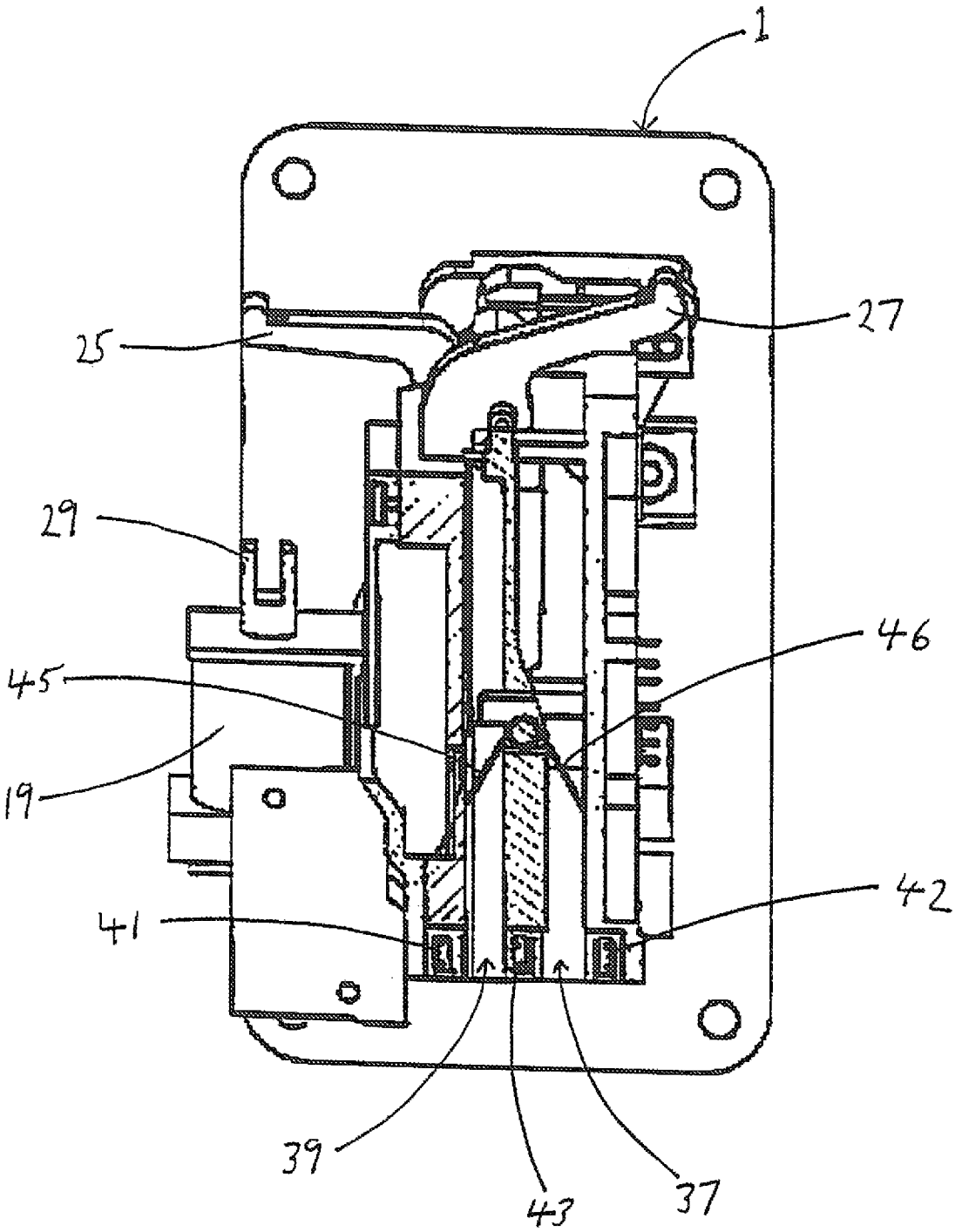
FIG. 4 is a rear cut away view of the embodiment illustrated in FIGS. 2 and 3.

Referring to FIG. 4, the sensors located in second sensor area 17 are illustrated in further detail. In this embodiment, a first coin race 39 and a second coin race 37 are shown having IR emitter 41 and IR emitter 42 positioned adjacent to the first and second coin races. Corresponding IR receivers are positioned adjacent the first and second coin races in receiver area 43. Light coin stop spring 45 is shown positioned across the first coin race and light coin stop spring 46 is shown positioned across the second coin race. The light coin stop springs are generally coil springs tensioned just strong enough to stop a light coin or object, such as a plastic coin-shaped object, but weak enough to allow an a coin of the proper weight to pass. In general the coil springs are wound such that each end of the coil spring rides in one of two slots in the coin race where the coins pass. As illustrated, the light coin stop springs are positioned upstream of the sensors. Once a light coin is stopped, it remains in the race, thereby triggering the actuator to open the rejector body. In an embodiment where only an upstream sensor is used, a light coin will be retained in the race until a heavier coin pushes the light coin through. Only the heavier coin will be given credit.

Numerous other variations and embodiments can be discerned from the above detailed description of the invention and illustrations thereof, and all such variations are encompassed within the scope and spirit of the present invention.

What is claimed is:

1. A method of rejecting jammed coins from a coin separator and rejector, comprising:

(a) programing a processor with a pre-selected minimum transit time and a pre-selected maximum transit time for a coin to transit a coin sensor located in a coin path in an upstream portion of a coin separator and rejector;

(b) sensing the transit time of a coin transiting said coin sensor located in said coin path in said upstream portion of said coin separator and rejector;

(c) sending a signal from said sensor to said processor;

(d) calculating the transit time of said coin transiting said coin sensor;

(e) comparing the transit time to said pre-selected minimum and maximum transit times; and (f) sending a signal from said processor to a coin rejection actuator if said coin transit time fails to fall within said pre-selected transit times.

2. A method of rejecting jammed coins from a coin separator and rejector, comprising:

(a) establishing an electronic signature for a coin with a first sensor located in a coin path in a coin separator and rejector;

(b) storing said electronic signature in a processor;

(c) establishing a predetermined transit time for a coin in said coin path to transit between said first sensor and a second sensor;

(d) storing said predetermined transit time in said processor;

(e) sensing a coin with said first sensor located in said coin path in said coin separator and rejector;

(f) sending a signal from said first sensor to said processor;

(g) waiting for said predetermined transit time for sensing a coin with said second sensor located in said coin path in said separator and rejector;

(h) sending a signal from said second sensor to said processor in the absence of a signal from said second sensor after said predetermined time period;

(i) comparing said signal from said first sensor with said electronic signature stored in said processor;

(j) sending a signal from said processor to a coin rejection actuator if said signal fails to match said electronic signature, and (k) sending a signal from said processor to said coin rejection actuator in the absence of a signal from said second sensor after said predetermined time period.

3. A method of rejecting jammed coins from a coin separator and rejector, comprising:

(a) establishing a predetermined period of time for a coin to transit a coin path between a first sensor located in an upstream portion of a coin separator and rejector and a second sensor located in a downstream portion of a said coin separator and rejector (b) storing said predetermined time period in a processor;

(c) detecting a coin in said upstream portion of said coin separator and rejector with said first sensor and sending a signal to a processor;

(d) waiting said predetermined time period for the detection of a signal by said processor from said second sensor; and (e) sending a signal from said processor to a coin rejection actuator in the absence of a signal from said second sensor after elapse of said predetermined time period.

* * * * *